US008167578B2

(12) United States Patent
Lin et al.

(10) Patent No.: US 8,167,578 B2
(45) Date of Patent: May 1, 2012

(54) SWITCH AND FLOAT ASSEMBLY FOR A PUMP

(75) Inventors: Chih Lin, Tipp City, OH (US); William J Watkins, Tipp City, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 382 days.

(21) Appl. No.: 12/495,134

(22) Filed: Jun. 30, 2009

(65) Prior Publication Data

US 2010/0329889 A1 Dec. 30, 2010

(51) Int. Cl.
*F04B 49/00* (2006.01)

(52) U.S. Cl. ..... 417/36; 417/40; 417/423.3

(58) Field of Classification Search ..... 417/36, 417/40, 423.3; 335/205–207; 200/84 R, 200/84 C; 73/305, 307, 314
See application file for complete search history.

(56) References Cited

U.S. PATENT DOCUMENTS 2,495,149 A * 1/1950 Taylor ..... 335/54
3,694,110 A * 9/1972 Guinard ..... 417/423.3
4,404,441 A * 9/1983 MacLaren ..... 200/84 C
4,984,973 A * 1/1991 Itameri-Kinter et al. ..... 417/422
5,297,939 A * 3/1994 Orth et al. ..... 417/40
5,562,422 A * 10/1996 Ganzon et al. ..... 417/40
6,461,114 B1 10/2002 Lin
7,026,898 B2 * 4/2006 Ableitner et al. ..... 335/205

* cited by examiner

*Primary Examiner* — Charles Freay
*Assistant Examiner* — Todd D Jacobs
(74) *Attorney, Agent, or Firm* — Standley Law Group LLP

(57) ABSTRACT

An assembly controls the liquid level in a vessel in which a submersible pump is disposed. The assembly has a switch housing and a float housing, arranged proximate to each other. A switch in the switch housing selectively energizes a motor associated with the pump. When a float disposed in the float housing moves in response to a change in the liquid level of the vessel, the movement is coupled to the switch by a pair of magnets arranged in attractive relationship to each other. One of the magnets is in the switch housing and the other is in the float housing. The magnets interact by providing force fields that acts through a wall that separates the switch housing and the float housing. A lever on which the switch housing magnet is positioned tilts the magnets away from alignment as they approach each other, reducing the increase in attractive force therebetween.

17 Claims, 3 Drawing Sheets

SWITCH AND FLOAT ASSEMBLY FOR A PUMP

CROSS-REFERENCE TO RELATED APPLICATIONS

This application is a non-provisional patent application, but it makes no priority claim.

1. Technical Field

The disclosed embodiments relate to an assembly for integrating a power supply and switch for a pump, especially a submersible pump, with a float device that reacts to a liquid level, especially in a basin in which the submersible pump is situated.

2. Background of the Art

A submersible pump is typically deployed as a sump pump in a basin located in a residence. In such an application, two important elements of the pump are the switch that controls the supply of electrical power to the motor and the liquid level sensing device, which is in communication with the switch, and which serves to cause the switch to activate or deactivate the motor of the pump, depending upon the liquid level that it senses in the basin.

Another feature of this type of submersible pump is the power supply cord, which provides electrical power from a location remote from the basin to the pump motor, which is enclosed in a moisture-resistant housing on or adjacent to the pump.

A number of patents are directed at isolating the motor and the switch from the moisture inherently present in the basin, while allowing a reliable communication between the level sensing device and the switch.

One such patent is U.S. Pat. No. 6,461,114, invented by one of the present inventors. In the device described there, the switch assembly is positioned inside the motor housing. An opening in the motor housing is required to allow a lever associated with the level sensing device to contact the switch, and a further opening is required to pass the power cord into the motor housing.

In another patent, U.S. Pat. No. 5,562,422, to Ganzon, the switch is housed in a switch chamber that is separate from the motor housing and the liquid level sensing device uses an attractive magnetic interaction between a lower actuator in an actuator chamber and an upper actuator that is in the switch housing, the actuator chamber and the switch housing being isolated from each other.

One aspect of the level sensing arrangements and switches that has remained consistent over time is the shorter life expectancy of these devices, relative to the pump and motor.

It is therefore an unmet advantage of the prior art to provide a modular switch and float arrangement that may be quickly and easily changed out in the event of failure.

SUMMARY

This and other unmet advantages are provided by an assembly for controlling the level of a liquid in a vessel in which a submersible pump is disposed. The pump is powered by a motor that is housed in a motor housing and is energized by an external power source. The level control assembly comprises a switch housing and a float housing, arranged in close proximity to each other. A float is disposed in the float housing and moves within the float housing responsive to the liquid level in the vessel. A switch disposed in the switch housing selectively connects the motor to, and disconnects the motor from, the external power source. The operation of the switch is coupled to the level of the float. A first portion of this coupling is movably disposed in the switch housing and a second portion of the coupling is disposed in the float housing. The portions interact by providing a force field that attracts the respective portions through a wall that separates the switch housing from the float housing. A relative angular relationship between the portions changes as the portions move toward and away from each other.

In some embodiments, the assembly also comprises a cord assembly that passes power from the external power source to the interior of the switch housing in an environmentally-sealed manner. Further, in some embodiments, the cord assembly has a power cord, adapted at a first end for connection to the external power source and communicating power therefrom in two lead wires and one ground wire, a plug, arranged at a second end of the power cord, for sealing engagement with an opening of the switch housing, the plug having two receptacles for engaging the switch internal to the switch housing, and quick connect tabs, for communicating electrical power passing through the switch to the motor.

In some embodiments, the switch is a snap-action switch.

In some embodiments, the cord assembly has an elastomeric saddle, provided on a face of the plug extending into the switch housing, for sealing the connection of the plug in the switch housing.

In some embodiments, part of the means that couples the switch to the float is a first magnet. The second magnet is in the float housing and attached to the float. A force field of the first magnet has an axis that is aligned with a vertical longitudinal axis of the float. The coupling means is also a second magnet. This second magnet is in the switch housing, and is arranged relative to the first magnet so that the force fields of the magnets attract rather than repel. The second magnet is associated with, and moves on, a lever that is configured to bear against and activate the switch as the magnets approach each other and to deactivate the switch as the magnets move apart.

In many of the embodiments, the means for changing the relative angular relationship of the force fields is provided by a path of limited arcuate rotation defined by the lever and the pivot point about which it moves. As a result, the second magnet has a force field that is tilted away from the force field axis of the first magnet as the respective magnets approach each other. In some of these embodiments, the means for changing the relative angular relationship further comprises a protrusion, positioned in the path of the second magnet, to tilt the second magnet as the second magnet moves toward the first magnet, misaligning the respective force fields.

In many of the embodiments, liquid access to an interior of the float housing is provided by a plurality of access holes in a lower surface of the float housing.

In many of the embodiments, the assembly further comprises a means for biasing the switch against force imposed by the lever thereupon through the attractive force of the magnets.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 1:
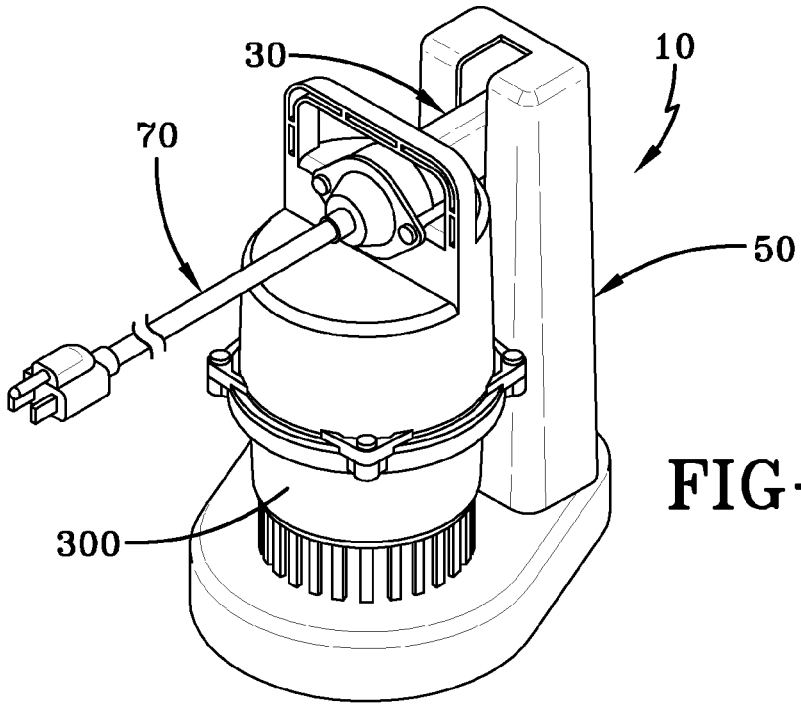
FIG. 1 is a perspective view of a first embodiment of the switch and float assembly.
Figure 2:
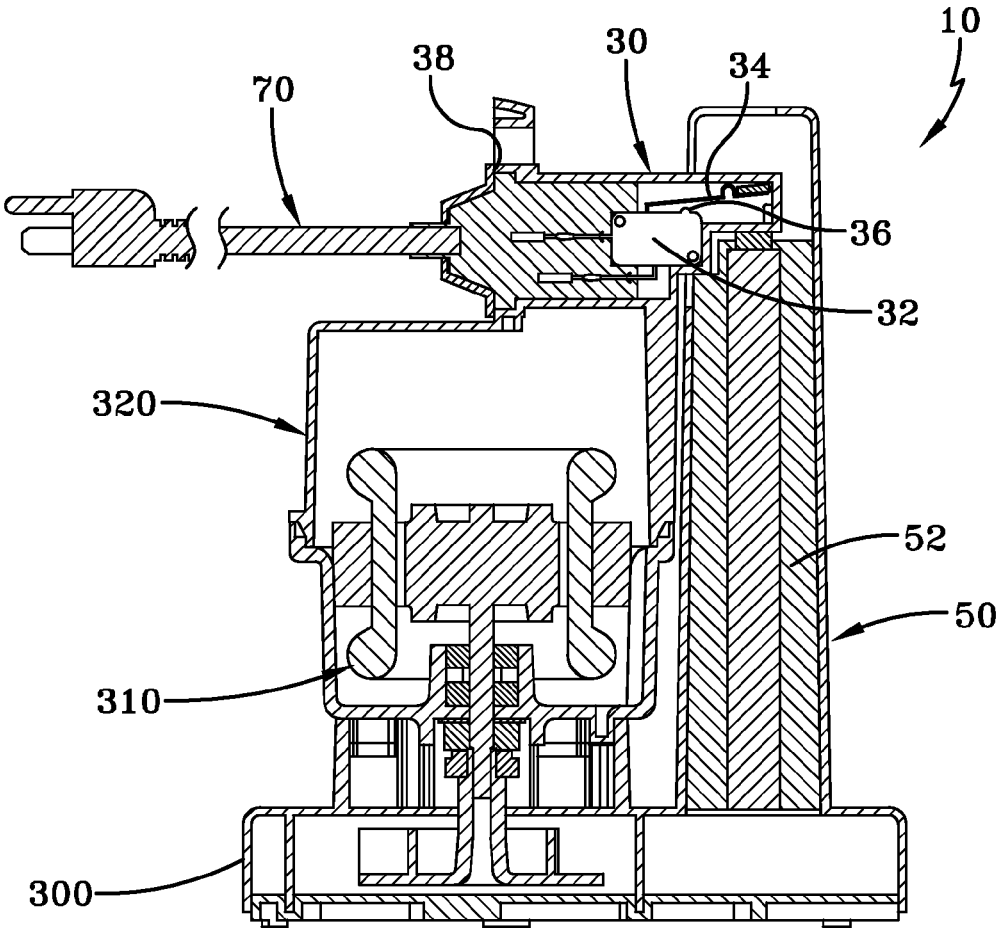
FIG. 2 is a side sectional view of the FIG. 1 assembly.

FIGS. 1 and 2 show, in perspective and side sectional views, a first embodiment of an assembly 10 for controlling the level of a liquid in a vessel, such as a sump basin or a sewer basin, in which a submersible pump 300, as is generally known in the prior art is disposed. The pump 300 has an electrical motor 310 housed in a motor housing 320. Such a pump 300 will be energized by an external power source (not shown), but this aspect is well known and the power will typically be 120 or 240 volt alternating current. As will be known, the pump 300 maybe a centrifugal impeller pump when the service involves a sump basin, but will more commonly be a grinder pump when the service involves a sewage basin. The level control assembly 10 has several pieces, including a switch housing 30, a float housing 50, and a cord assembly 70 that passes the power from the external power source to the interior of the switch housing in an environmentally-sealed manner.

The float housing 50 is arranged in close proximity to the switch housing 30, and a float 52 is disposed in the float housing for linear movement in a vertical direction that is responsive to the liquid level in the vessel. Unlike some of the float assemblies that have been used in the prior art, it is desirable to enclose the float 52 in the float housing 50. When the float 52 or, for that matter, a switch associated with the float, is exposed in the sump basin to the rippling of the liquid in the basin, multiple strikes of the switch contacts can occur. This tends to shorten the service life of the switch. This rippling can be caused, for example, by the flow of liquid from a footer pipe into the basin. In general, then, a particularly useful float housing 50 is effectively closed along its sides, with liquid access to the interior of the float housing provided by a plurality of access holes in a lower surface of the float housing. To accommodate air inside the float housing 50, it may also be useful to provide access holes at the upper end of the float housing.

The float 52 should be sized to slide easily upward and downward in the float housing 50. The float 52 has a density that can be carefully determined to provide the correct reaction to an increased liquid level, which may include, in some instances, filling at least some of the float with water, or another dense material. Having an appropriate weight to the float 52 is important in the proper operation of the switching system, as there needs to be sufficient weight present to counteract the attractive force of the magnets used to couple the action of a switch in the switch housing 30 with the float.

The switch housing 30 is intended to provide a sealable internal environment that is distinct from either the motor housing 320, a pump housing (if the pump housing is separate from the motor housing, although they can be the same) and the float housing 50. Unlike the float housing 50, which will be subjected to humidity, the switch housing 30 should be as dry as possible. Unlike the motor housing 320, where oil mist from the motor will be commonplace, the switch housing 30 should be free of oil mist.

A switch 32 is disposed in the switch housing 30. The switch 32 is positioned in an electrical circuit provided between the motor 310 and the external power source operative to selectively connect the motor to, and disconnect the motor from, the external power source, as required to maintain the liquid level. In the illustrated embodiment, the switch 32 is a snap-action switch. To the extent that there is a preference, the switch 32 is preferably a commercially-available snap action switch that is provided with a pivoted lever 34 that can be urged against a switch button 36 that is biased against the action of the lever. Certainly, the lever 34 may be provided if it is not an integral part of the switch 32.

Figure 3:
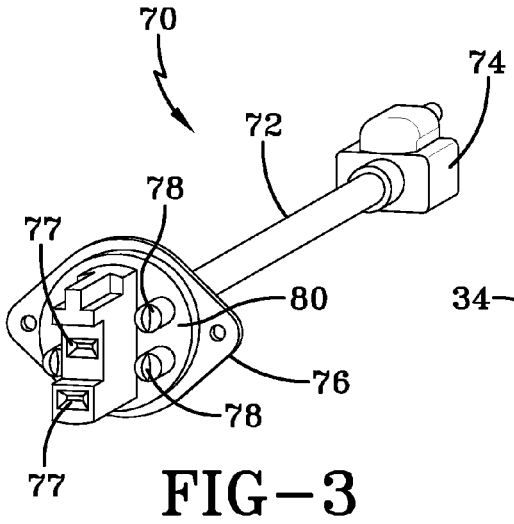
FIG. 3 is an isolated perspective view of a cord assembly of the FIG. 1 assembly.
Figure 4:
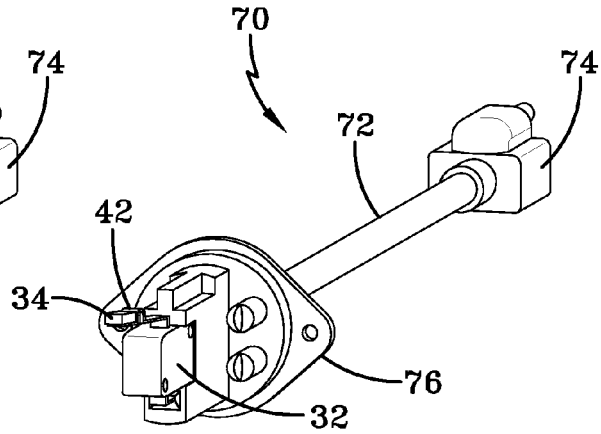
FIG. 4 is an isolated perspective view of the FIG. 3 cord assembly, with a switch installed therein.

Attention is now directed to FIGS. 3 and 4, where details of the cord assembly 70 and the switch 32 are disclosed. Along a length of the assembly 70, a power cord 72 communicates electrical power through two lead wires and one ground wire that run the length of the power cord. These leads and ground will usually be connected to a plug at a first end of the cord assembly 70, the first end being adapted for connection to the external power source. Since the power source will usually be a 120 or 240 volt alternating current source, the first end will normally be a conventional electrical plug 74 for connection to such a source. At the second or opposite end of the power cord, a plug 76 will also be provided. This second plug 76 is intended to be sealingly engaged in an opening 38 of the switch housing 30. A side of the plug 76 that is internal to the switch housing 30 when the power cord assembly 70 is received therein, that is, a side that is opposite the power cord 72, is preferably provided with receptacles 77 to receive the plugs on the switch 32 that is selected for use. This allows quick and easy replacement of the switch 32 when necessary. The same side of the plug 76 is also preferably provided with quick connect tabs 78, for communicating electrical power passing through the switch 32 to the motor 310, while keeping the switch housing 30 and the motor housing 320 isolated from each other. It is also preferred to provide an elastomeric shield or saddle 80 on the face of this side of the plug 76, for sealing the connection of the plug in the switch housing 30. While FIG. 3 shows the cord assembly 70 without the switch 32 connected, FIG. 4 shows the assembly with the switch in place. The plug 76 retains the body of the switch 32 during the actuation of the switch, allowing movement only of the lever 34. FIG. 4 also shows the lever 34 and the second magnet 42, more details of which are provided below.

Figure 5:
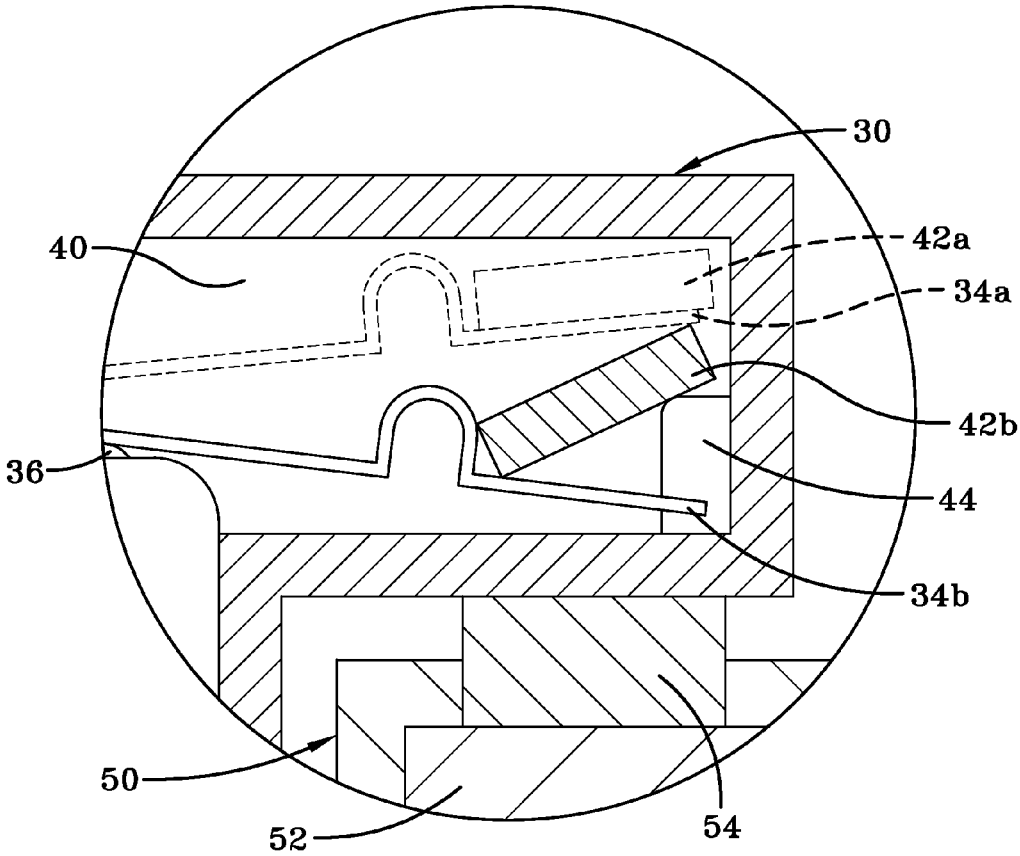
FIG. 5 is an enlarged view of the switch housing of the FIG. 1 assembly, showing details of the movement of the lever.

Referring to FIG. 2 and FIG. 5, the coupling of the switch 32, located in the switch housing 30, with the float 52, located in the float housing 50 is now described. The switch housing 30 and float housing 50 are to be maintained in isolation from each other, and the coupling is achieved through the interacting attractive magnetic force fields of a pair of magnets. The first magnet 54 is positioned in the float housing 50 and is attached to the top of the float 52. It is preferred to position this magnet 54 so that the force field associated with it has an axis that is aligned with a vertical longitudinal axis of the float 52. As the float 52 moves upwardly and downwardly within the float housing 50, the strength of the magnetic field from this magnet 54 increases and decreases in the switch housing 30, as a wall separating the switch housing and the float housing is selected from a material that readily allows the magnetic field to pass therethrough. In the illustrated embodiment, a portion 40 of the switch housing 30 extends into an upper portion of the float housing 50, resulting in that portion being placed into the longitudinal axis of the float housing.

A second magnet 42 is positioned in the switch housing 30 and, particularly, is positioned in the portion 40. The second magnet 42 is seated at an end of the lever 34 of the switch 32.

The polarities of the magnets 42, 54 are set so that the magnets attract each other, rather than repel each other.

In this first embodiment 10, the second magnet 42 moves in a path defined by a limited arc of rotation about a pivot point 39 where the lever 34 is attached to the switch 32. Because of this rotational limit, the force field of the second magnet 42 has an axis that tilts with regard to the vertical, arriving at the vertical as the switch 32 is activated by the force of the lever 34 acting on the switch button 36.

In FIG. 5, the lever 34 is shown at the limits of its range of motion. Depicted as lever 34*a* at the top of the range, second magnet 42*a* has its force field axis tilted slightly to the vertical. As the attractive force of a rising first magnet 54 draws the second magnet downward, the lever 34*b* and the second magnet 42*b* are shown at the bottom of the range of motion.

As also seen in FIG. 5, when the second magnet 42 arrives at a point in its arc where its force field approaches being co-axial with that of the first magnet 54, a part of a means for changing the relative angular relationship of the force fields comes into play. In this embodiment, this means is represented by a tang 44 that protrudes into the path of the second magnet 42. Contact with the second magnet 42 by the tang 44 tilts the second magnet in a seat in which it is positioned. Accordingly, this tilting misaligns the force fields. The tilting results in a reduction in the rate of increase in the attractive force between the magnets that would result if the force fields remained aligned as the separation decreases. In turn, this decreases the difference in magnetic force between the point where the switch 32 is activated and where it is deactivated, allowing the size of the float 52 and its weight to be minimized. The known prior art devices require a heavier float to break the attractive force between magnets with continually aligned force fields. As the lever 34 rises away from the lowered position when the float magnet 54 moves away, the second magnet 42 resumes its position in the seat as the tang 44 no longer tilts the second magnet.

Once the magnets move far enough apart that the switch 32 is turned off, the arcuate tilt of the first magnet's force field decreases the attractive force even more rapidly than the inverse square of the distance rule that applies during axial alignment. Accordingly, the assembly provides a very clean action, with attenuated sensitivity as the magnets 42, 54 are in near axial alignment.

Fortuitously, switch button 36 of the typical commercially-available snap action switch 32 is already provided with a means that biases the switch button against the downward force imposed by the lever 34 through the attractive force of the magnets.

Figure 7:
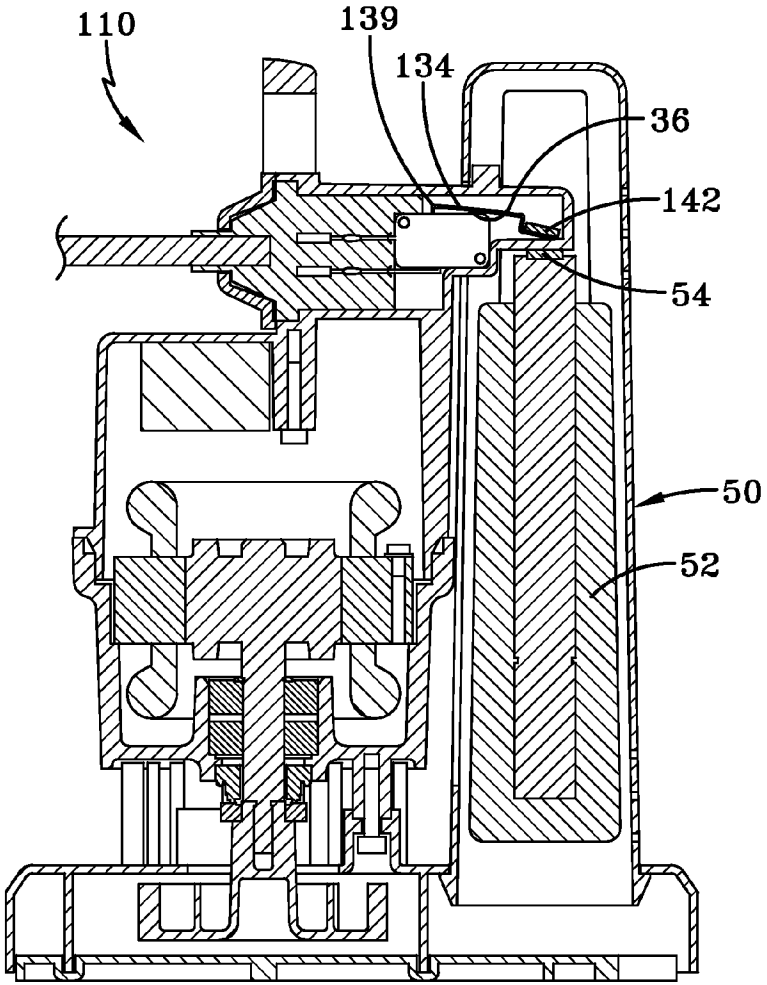
FIG. 7 is a second side sectional view of the FIG. 6 embodiment, with the float in its raised position.
Figure 6:
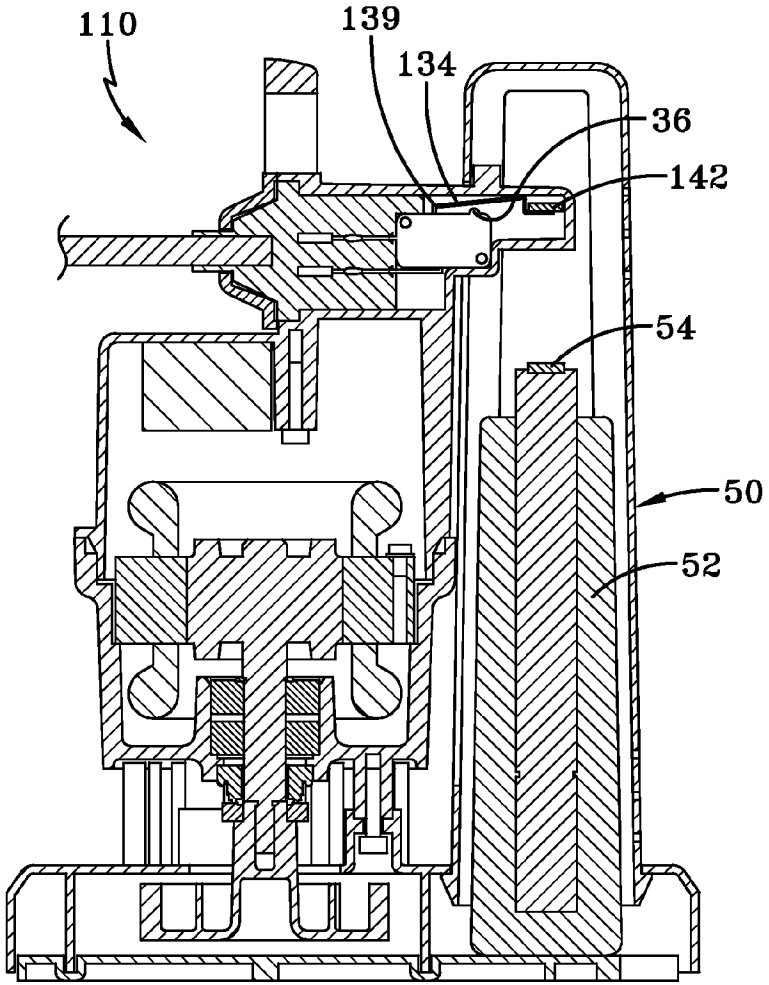
FIG. 6 is a first side sectional view of a second embodiment of the switch and float assembly, with the float in a lowered position; and'

A further embodiment 110 of the assembly is presented in FIGS. 6 and 7. Because a large proportion of the structures are unchanged in FIGS. 6 and 7, many structures that are substantially identical to those in the prior figures are identified with the same reference numbers and are only discussed in relation to the changed structures, which are identified with new reference numbers. In this embodiment, the first magnet 54 has substantially the same vertical motion as described with regard to the prior figures. However, and because of a variety of differences, including but not limited to the position of the switch 32 relative to the float housing 50, the lever 134 limits the movement of the second magnet 142 to an arc of rotation about a pivot point 139 where the lever 134 is attached to the switch 32. In this case, however, the top of the range, as seen in side sectional view in FIG. 6, has the second magnet 142 with its magnetic force field essentially aligned with that of the first magnet 54. In this position, the float 52 is lowered and the pump is not activated, because the switch 32 is "off", with switch button 36 in its raised position. As float 52 begins to rise from accumulating water in the basin, first magnet 54 rises with the float, increasing the attractive magnetic force in the switch housing. However, as the second magnet 142 moves toward first magnet 54 and the lever 134 bears on switch button 36, the force field of the second magnet 142 is tilted away from the alignment and the tilting continues as long as the second magnet moves downward. At its lower limit, as shown in FIG. 7, the lever 134 contacts a top portion of the wall separating the float housing from the switch housing. In this position, the attraction of the magnets 142, 54 to each other is decreased because of the tilt that has occurred, allowing the magnets to move easily separate upon a reduction of the liquid level in the vessel from the activation of the pump.

What is claimed is:

1. An assembly for controlling the level of a liquid in a vessel in which a submersible pump is disposed, the pump powered by a motor housed in a motor housing thereof, the motor energized by an external power source, the level control assembly comprising:

a switch housing;

a float housing, arranged in close proximity to the switch housing;

a float, disposed in the float housing and operative to move therewithin responsive to the liquid level in the vessel;

a switch, disposed in the switch housing and operative to selectively connect the motor to, and disconnect the motor from, the external power source;

means for coupling the operation of the switch to the level of the float through interacting attractive magnetic force fields, the means comprising:

a first magnet, in the float housing and attached to the float, the magnetic force field thereof having an axis that is aligned with a vertical longitudinal axis of the float;

a second magnet, in the switch housing, the first and second magnets arranged such that the respective force fields are attractive, the second magnet arranged to activate the switch as the respective magnets approach each other and to deactivate the switch as the magnets move apart; and means for changing a relative angular relationship of the force field between the respective magnets as the magnets move toward and away from each other, comprising a lever having a path of limited arcuate rotation, so the force field axis of the second magnet is tilted away from the force field axis of the first magnet as the respective magnets approach each other and the lever bears against, and activates, the switch as the magnets approach each other.

2. The assembly of claim 1, further comprising:

a cord assembly that passes power from the external power source to the interior of the switch housing in an environmentally-sealed manner.

3. The assembly of claim 2, wherein:

the cord assembly further comprises:

a power cord, adapted at a first end for connection to the external power source and communicating power therefrom in two lead wires and one ground wire;

a plug, arranged at a second end of the power cord, for sealing engagement with an opening of the switch housing, the plug having two receptacles for engaging the switch, inside the switch housing; and quick connect tabs, for communicating electrical power passing through the switch to the motor.

4. The assembly of claim 3, wherein:

the switch is a snap-action switch.

5. The assembly of claim 3, further comprising:

an elastomeric saddle, provided on a face of the plug extending into the switch housing, for sealing the connection of the plug in the switch housing.

6. The assembly of claim 1, wherein:

the means for changing the relative angular relationship further comprises a protrusion, positioned in the path of limited arcuate rotation of the second magnet, to further tilt the second magnet as the second magnet moves toward the first magnet, misaligning the respective force fields.

7. The assembly of claim 1, further comprising:

means for biasing the switch against force imposed by the lever thereupon through the attractive force of the magnets.

8. An assembly for controlling the level of a liquid in a vessel in which a submersible pump is disposed, the pump powered by a motor housed in a motor housing thereof, the motor energized by an external power source, the level control assembly comprising:

a switch housing;

a float housing, arranged in close proximity to the switch housing;

a float, disposed in the float housing and operative to move therewithin responsive to the liquid level in the vessel;

a snap action switch, disposed in the switch housing and operative to selectively connect the motor to, and disconnect the motor from, the external power source;

a power cord, adapted at a first end for connection to the external power source and communicating power therefrom in two lead wires and one ground wire;

a plug, arranged at a second end of the power cord, for sealing engagement with an opening of the switch housing, the plug having two receptacles for engaging the snap action switch, inside the switch housing;

quick connect tabs, for communicating electrical power passing through the switch to the motor;

an elastomeric saddle, provided on a face of the plug extending into the switch housing, for sealing the connection of the plug in the switch housing;

a first magnet, in the float housing and attached to the float, a force field of the magnet having an axis that is aligned with a vertical longitudinal axis of the float;

a second magnet, in the switch housing and operatively co-acting with a lever of the switch, the first and second magnets arranged such that the force field therebetween is attractive; and a lever on which the second magnet moves, defining a path of limited arcuate rotation, so a force field axis of the second magnet is tilted away from alignment with the force field axis of the first magnet as the magnets approach each other, the approach of the magnets towards each other serving to activate the snap-action switch.

9. An assembly for controlling the level of a liquid in a vessel in which a submersible pump is disposed, the pump powered by a motor housed in a motor housing thereof, the motor energized by an external power source, the level control assembly comprising:

a switch housing;

a float housing, arranged in close proximity to the switch housing;

a float, disposed in the float housing and operative to move therewithin responsive to the liquid level in the vessel;

a switch, disposed in the switch housing and operative to selectively connect the motor to, and disconnect the motor from, the external power source;

a lever, arranged in the switch housing to activate the switch when the lever moves from a first position to a second position;

a first magnet, in the float housing and attached to the float, the magnetic force field thereof having an axis that is aligned with a vertical longitudinal axis of the float; and a second magnet, positioned on the lever, such that a magnetic force field of the second magnet is generally aligned in an attracting manner with the magnetic force field of the first magnet when the lever is in the first position and the respective magnetic force fields move away from alignment as the first and second magnets approach each other, moving the lever to the second position.

10. The assembly of claim 8, further comprising:

means for biasing the switch against force imposed by the lever thereupon through the attractive force of the magnets.

11. The assembly of claim 9, further comprising:

means for biasing the switch against force imposed by the lever thereupon through the attractive force of the magnets.

12. The assembly of claim 8, further comprising:

a protrusion, positioned in the path of limited arcuate rotation of the second magnet, to further tilt the second magnet as the second magnet moves toward the first magnet, misaligning the respective force fields.

13. The assembly of claim 9, further comprising:

a protrusion, positioned in the path of limited arcuate rotation of the second magnet, to further tilt the second magnet as the second magnet moves toward the first magnet, misaligning the respective force fields.

14. The assembly of claim 9, further comprising:

a cord assembly that passes power from the external power source to the interior of the switch housing in an environmentally-sealed manner.

15. The assembly of claim 14, wherein:

the cord assembly further comprises:

a power cord, adapted at a first end for connection to the external power source and communicating power therefrom in two lead wires and one ground wire;

a plug, arranged at a second end of the power cord, for sealing engagement with an opening of the switch housing, the plug having two receptacles for engaging the switch, inside the switch housing; and quick connect tabs, for communicating electrical power passing through the switch to the motor.

16. The assembly of claim 15, wherein:

the switch is a snap-action switch.

17. The assembly of claim 15, further comprising:

an elastomeric saddle, provided on a face of the plug extending into the switch housing, for sealing the connection of the plug in the switch housing.

* * * * *